US006190141B1

(12) United States Patent
Henry

(10) Patent No.: US 6,190,141 B1
(45) Date of Patent: Feb. 20, 2001

(54) CENTRIFUGAL PUMP WITH DILUENT INJECTION PORTS

(75) Inventor: Joe V. Henry, Claremore, OK (US)

(73) Assignee: Baker Hughes Incorporated, Houston, TX (US)

( * ) Notice: Under 35 U.S.C. 154(b), the term of this patent shall be extended for 0 days.

(21) Appl. No.: 09/033,112

(22) Filed: Mar. 2, 1998

Related U.S. Application Data

(60) Provisional application No. 60/047,309, filed on May 21, 1997.

(51) Int. Cl.[7] ..... F04B 35/04; E21B 43/00

(52) U.S. Cl. ..... 417/423.3; 166/105; 166/105.5

(58) Field of Search ..... 166/105, 105.5, 166/105.6; 417/423.3, 251, 250, 424.2, 423.5, 205

(56) References Cited

U.S. PATENT DOCUMENTS 2,214,064 * 9/1940 Niles ..... 166/54
4,025,238 * 5/1977 Masclet ..... 417/203
4,481,020 * 11/1984 Lee et al. ..... 96/215
4,582,131 * 4/1986 Plummer et al. ..... 166/68
4,749,034 * 6/1988 Vandevier et al. ..... 166/105
5,000,264 * 3/1991 Snider ..... 166/372
5,516,360 * 5/1996 Normandeau et al. ..... 96/207

* cited by examiner

*Primary Examiner*—Charles G. Freay
*Assistant Examiner*—David J. Torrente
(74) *Attorney, Agent, or Firm*—Felsman, Bradley, Vaden, Gunter & Dillon, L.L.P.; James E. Bradley

(57) ABSTRACT

An electrical submersible pump assembly has a diluent fluid injection line to reduce viscosity of well fluid. The electrical submersible pump includes impellers for displacing well fluids, and a base member having an intake port for receiving well fluid. An inducer having a helical flight is mounted below the impellers in the base member. The submersible pump is additionally provided with injection ports, preferably radially spaced around the base member proximate the inducer through which diluent is injected for mixing with the well fluid. The diluent is pumped down to the injection ports by an injection line that runs down from the surface.

18 Claims, 3 Drawing Sheets

CENTRIFUGAL PUMP WITH DILUENT INJECTION PORTS

This application claims benefit of provisional application Ser. No. 60/047,309, filed May 21, 1997.

TECHNICAL FIELD

This invention relates in general to electrical submersible well pumps, and in particular to a centrifugal pump with injection ports for injecting fluids to reduce viscosity of the well fluid being pumped. More particularly, the device is useful in wells producing heavy oil, where reducing fluid viscosity is especially important.

Related art devices have been used to distribute a chemical below a submersible pump. An example of such a device is described in U.S. Pat. No. 4,582,131, which utilizes a secondary pump for injecting chemicals below the motor. The secondary pump has an intake connected to an intake tube that extends upwardly above the intake of the primary pump. Chemicals introduced into the annulus at the surface flow down the annulus and into the intake tube and are discharged below the motor. Another device, described in U.S. Pat. No. 4,749,034, is a well pump assembly that has a tube extending into a well for delivering water to a point below the pump for reducing viscosity of oil being pumped.

SUMMARY OF THE INVENTION

According to the present invention, a centrifugal pump for use in an electrical submersible well pump assembly is provided that includes a submersible pump having impellers for displacing well fluid and an inducer attached to the pump for inducing well fluid to flow into the impellers. One or more injection ports are provided in a sidewall of the pump proximate to the inducer for injecting diluent into the pump for mixing diluent with well fluid. The diluent is fed to the injection port by an injection line that transmits fluid from an injection pump on the surface into the submersible pump. Preferably, a plurality of injection ports are positioned radially about the submersible pump and are in communication with an annular interior chamber for injecting diluent into the pump for mixing with well fluid. Additionally, it is preferred that the injection ports are positioned along a length of the inducer so that diluent is mixed with well fluid in the inducer. The inducer is preferably a helical screw pump. It is preferred that the pump is comprised of a pump section and a pump base, wherein the pump base houses the inducer.

In practice, diluent is transferred via one or more injection lines from ground level to injection ports positioned radially about the pump. Diluent is injected into the pump so that the diluent is acted upon by an inducer and mixed with well fluid to form a mixture.

BEST MODE FOR CARRYING OUT THE INVENTION

Figure 1:
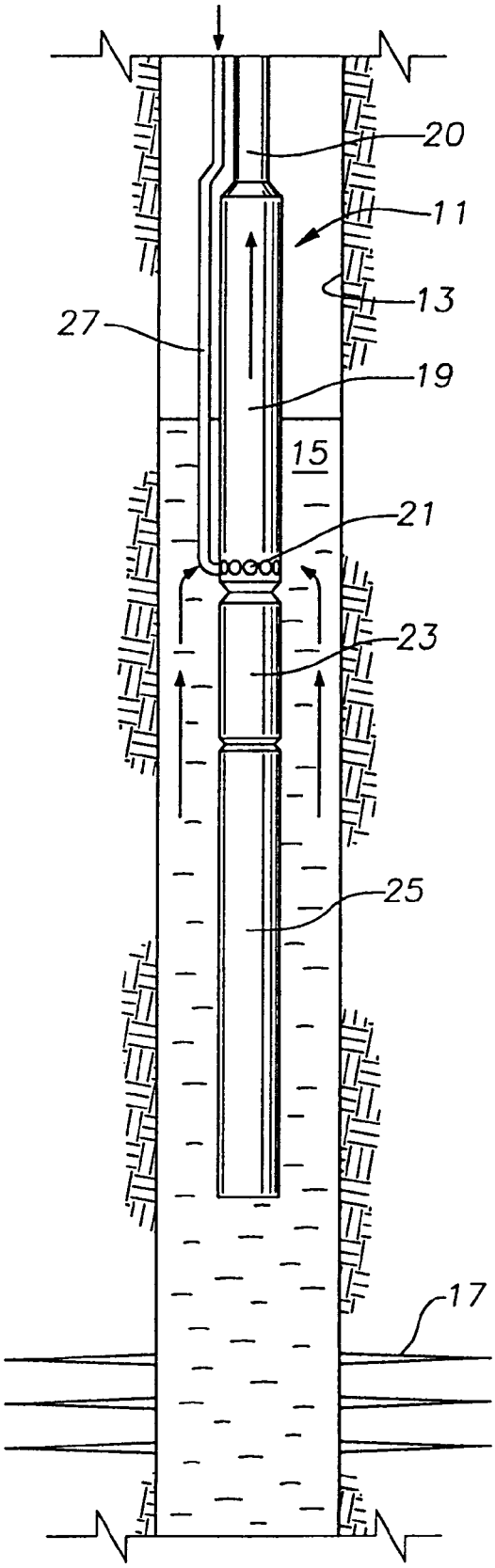
FIG. 1 is a schematic view illustrating an electrical submersible pump assembly installed in a well and having diluent injection ports in accordance with this invention.

Referring to FIG. 1, an electrical submersible pump assembly 11 is shown installed within a well 13. Well 13 contains a well fluid 15 which flows inward from perforations 17. In the application of this invention, well fluid 15 will typically be a heavy viscous crude.

Pump assembly 11 includes a centrifugal pump 19 which has a well fluid inlet or lower intake 21. Pump 19 is suspended by a string of production tubing 20, and its lower end is mounted to a conventional seal section 23. An electrical motor 25 is supported on the lower end of seal section 23. Seal section 23 seals well fluid from lubricant within electrical motor 25 and also reduces the pressure differential between the hydrostatic pressure in the well and the internal pressure of the lubricant in the motor. Additionally, seal section 23 has thrust bearings for absorbing axial thrust generated by pump 19. Electrical motor 25 is a large AC motor which is supplied with electrical power through a power cable (not shown) extending down from the surface.

An injection line 27 also extends downward from the surface. Injection line 27 is a small diameter tube, that can be seen more clearly in FIG. 2. Injection line 27 is connected to a reservoir and pump (not shown) at the surface. The lower end of injection line 27 terminates at the lower end of pump 19. Injection line 27 is used to supply a diluent fluid such as kerosine or naphtha near intake 21 of pump 19. The diluent fluid is for diluting well fluid 15 as it flows into pump intake 21.

Figure 2:
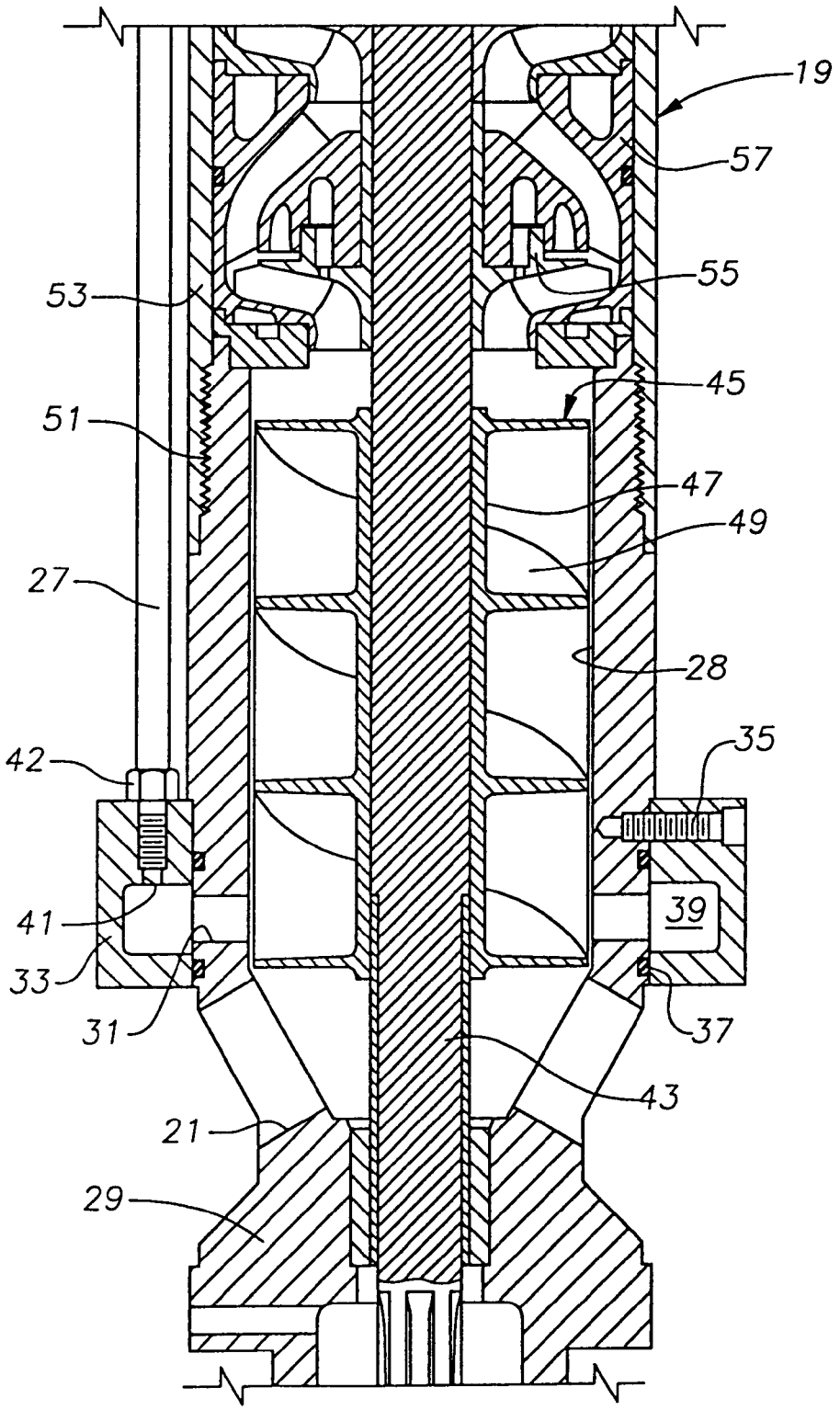
FIG. 2 is an enlarged sectional view of a lower portion of the pump of FIG. 1.

Referring to FIG. 2, the lower end of pump 19 has a pump base 29 affixed thereto. Pump base 29 is secured by bolts (not shown) to seal section 23 (FIG. 1). Pump base 29 is a tubular member having a sidewall 30 that defines a bore 28. Sidewall 30 may contain a single injection port 31 for receiving the lower end of injection line 27. However, in the preferred embodiment, sidewall 30 contains a plurality of radial injection ports 31 which extend radially from bore 28 to the exterior of sidewall 30. Injection ports 31 are spaced a short distance above intake ports 21, which are larger in diameter. An annular manifold 33 is secured to pump base 29 and surrounds injection ports 31. Manifold 33 is secured to pump base 29 by bolts 35. Upper and lower seals 37 seal manifold 33 above and below injection ports 31. Manifold 33 has an annular interior chamber 39 that communicates with injection ports 31. An inlet passage 41 extends through an upper side of manifold 33 parallel to the longitudinal axis of pump 19 and into chamber 39. Inlet passage 41 is threaded, and injection line 27 connects to inlet passage 41 by means of a pipe fitting 42.

An axial shaft 43 extends through pump base 29. Shaft 43 couples to a shaft (not shown) extending upward from seal section 23 (FIG. 1), which is driven by electrical motor 25 (FIG. 1). Inducer 45 is mounted to shaft 43 and located within bore 28. Inducer 45 is a helical screw pump, having a hub 47 that slides over shaft 43 and rotates with shaft 43 by means of a key. A flight 49 extends outward from hub 47. Flight 49 is helical and has an outer periphery in close proximity to sidewall 30 of pump base 29. Inducer 45 has a length that is less than the length of pump base 29. The lower end of inducer 45 is below injection ports 31 so that diluent fluid flowing in will flow into inducer 45 at a point above its lower end.

Pump base 29 has a set of exterior threads 51 on its upper end. A tubular housing 53 secures pump base 29 to an upper portion of pump 19. The remaining portions of pump 19 are conventional. Pump 19 has a large number of pumping stages, each having a rotating impeller 55 and stationary diffuser 57.

In operation, electrical power is supplied to motor 25 to drive pump 19. As indicated by the arrows in FIG. 1, well fluid 15 flows into intake ports 21. At the same time, a surface pump (not shown) pumps diluent fluid down injection line 27 and into inducer 45. Inducer 45 rotates with shaft 43, mixing the diluent fluid with well fluid 15, which reduces the viscosity of well fluid 15 before it reaches the pump impellers and diffusers 55, 57 (FIG. 2). As well as mixing, inducer 45 also acts as a low pressure pump stage to induce flow into impellers and diffusers 55, 57.

Figure 3:
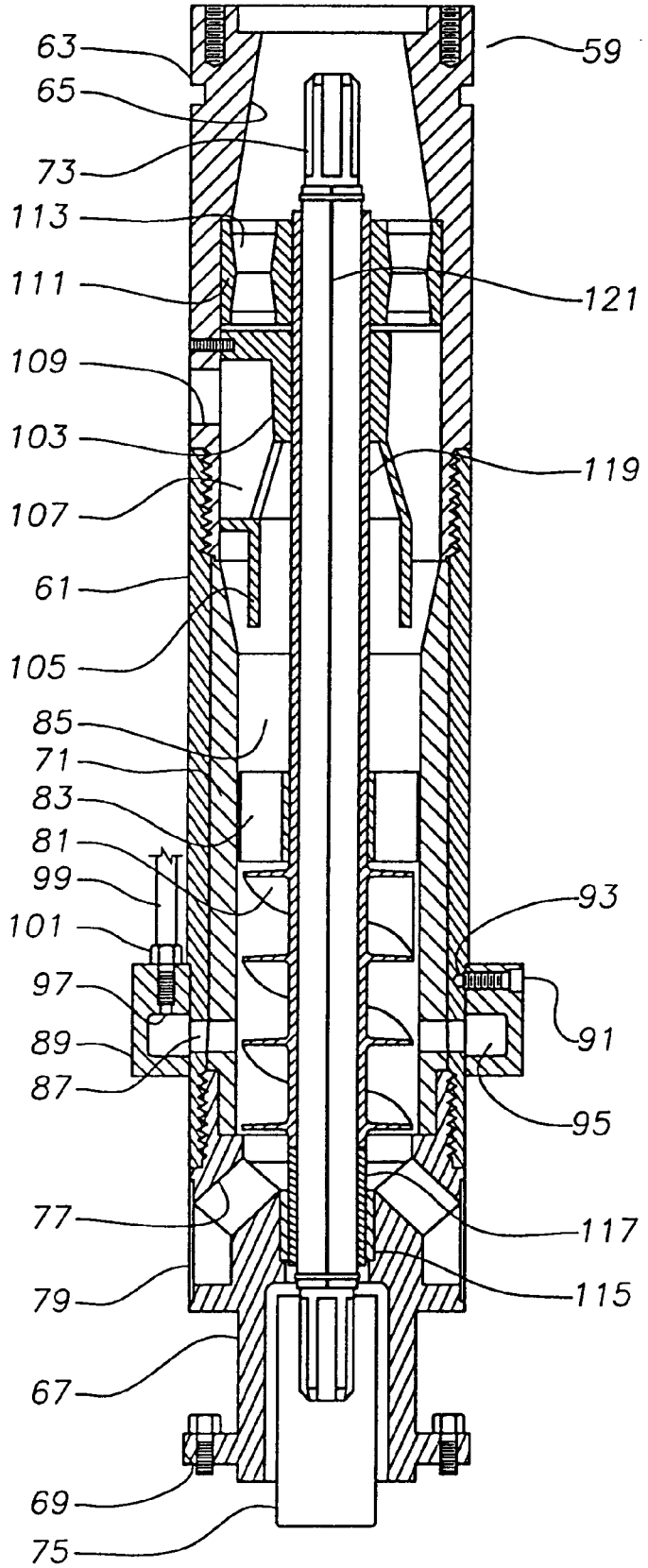
FIG. 3 is a sectional view of an alternate embodiment of a lower portion of the pump of FIG. 1, which houses a gas separator.

In some installations it may be advantageous to provide a gas separator 59 with an electrical submersible pump assembly 11. Gas separator 59 may be any type of separator including a rotary separator or a static separator. Referring to FIG. 3, gas separator 59 is a tubular member having a side wall or housing 61. A head 63 secures to the upper end of housing 61 by threads, although other means of attachment such as a bolt-on arrangement may be used. Head 63 is adapted to an intake or lower end of a conventional submersible centrifugal pump. Head 63 has an axial discharge passage 65. A base 67 secures to the lower end of housing 61 by threads or other attachment means. Base 67 is secured by bolts 69 to the upper end of a seal section (not shown) of a motor.

The side wall of gas separator 59 includes a tube 71 that extends closely within housing 61. Tube 71 extends from base 67 to head 63. A shaft 73 extends axially through housing 61. A coupling 75 is schematically shown for coupling shaft 73 to a driven shaft from a seal section and motor (not shown). The upper end of shaft 73 connects to the pump.

A plurality of inlet ports 77 are located in base 67. Inlet port 77 inclines upward for drawing fluid into the lower end of tube 71. Optional screens 79 may be employed over inlet ports 77 if desired. An inducer 81 is mounted to shaft 73 for rotation therewith. Inducer 81 is a helical screw type pump. It comprises a helical flight, which when rotated, will pump a well fluid upward. A guide vane 83 mounts directly above inducer 81 for rotation with shaft 73. Guide vane 83 comprises one or more flat or curved plates, each being inclined relative to the axis of shaft 73 for imparting a swirling motion to the fluid being pumped by inducer 81.

A straight through bore section 85 is located above guide vane 83. Straight through bore section 85 comprises a section of bore which is free of any rotating components that might otherwise impart any centrifugal force or motion to the well fluid. Straight through bore section 85 has a length selected which allows the swirling well fluid to separate into heavier liquid components near the outer wall of tube 71 and lighter gaseous components near the shaft 73.

Housing 61 contains a plurality of radial injection ports 87 which extend radially from bore section 85 to the exterior of housing 61. Injection ports 87 are spaced above inlet ports 77 which are larger in diameter. An annular manifold 89 is secured to base 67 and surrounds injection ports 87. Manifold 89 is secured to base 67 by bolts 91. Upper and lower seals 93 seal manifold 89 above and below injection ports 87. Manifold 89 has an annular interior chamber 95 that communicates with radial injection ports 87. An inlet passage 97 extends through an upper side of manifold 89 parallel to the longitudinal axis of gas separator 59 and into chamber 95. Inlet passage 97 is threaded and injection line 99 connects to inlet passage 97 by means of pipe fitting 101.

A discharge member 103 is mounted stationarily in housing 61 and head 63 at the upper end of straight through bore section 85. Discharge member 103 has lower lip 105 that is circular and locates approximately midway between shaft 73 and tube 71. The interior of lip 105 defines an inner collection area around shaft 73 for collecting the separated gas. Three gas passages 107 (only one shown) join the inner collection area with lip 105. Each gas passage 107 registers with a gas discharge port 109 formed in head 63 which may be considered a portion of the side wall of gas separator 59. The gas will flow out ports 109 and discharge to the exterior of gas separator 59. The liquid components in an outer area near the wall of tube 71 flow around the exterior of lip 105 upward through bearing 111. Bearing 111 has axial passages 113 for fluid to flow upward through discharge passage 65 to the intake of the pump. Shaft 73 is supported by a bushing 115 on its lower end. Shaft 73 is protected from sand abrasion by a sleeve which comprises a lower sleeve 117 located in bushing 115 and upper sleeve 119. Upper sleeve 119 extends from guide vane 83 upward through bearing 111. Sleeves 117 and 119 rotate with shaft 73. A key 121 causes sleeves 117 and 119 as well as guide vane 83 and inducer 81 to rotate with shaft 73.

The components of gas separator 59 exposed to the flowing fluid have hardened cases for resisting abrasion from sand. The hardened cases are formed conventionally and may have hardness selected to best resist abrasion such as a hardness greater than 50 Rockwell "C". The hardened cases are located on bushing 115, sleeves 117, 119, inducer 81, guide vane 83, the inner wall of tube 71 and a bushing within bearing 111.

In the operation of gas separator 59, well fluid will flow through entry ports 77 as a result of the rotation of inducer 81. Inducer 81 applies pressure to the well fluid which flows upward through guide vane 83. The guide vane 83 imparts a swirling motion to the well fluid causing separation between the gas and liquid in the straight through bore section 85. The heavier liquid flows on the outer side of lip 105 up through bearing passages 113 and discharge passage 65, where the liquid flows into the intake of the pump. The gas flows within the interior of lip 105 and through the gas passages 107 and outlet ports 109.

Although inducer 81 and guide vane 83 impart a swirling motion to the well fluid they do not impose a high velocity centrifugal force to the well fluid. The velocities of the flowing fluid are much lower than velocities created by a rotating rotor or an impeller pump stage of the prior art types. By injecting diluent into radial injection ports 87, heavy fluids may be diluted and gas separated with gas separator 59 before the pump fluid enters an electrical submersible pump.

The invention has significant advantages. By injecting diluent chemicals directly into an intake of a submersible pump, the amount of diluent mixed with well fluid may be more carefully controlled.

While the invention is shown in only one of its forms, it should be apparent to those skilled in the art that it is not so limited, but is susceptible to various changes without departing from the scope of the invention.

What is claimed is:

1. An electrical submersible well pump assembly comprising:

a centrifugal pump having a plurality of impellers rotated by a shaft;

a base member mounted to the centrifugal pump assembly, the base member having a side wall and a well fluid inlet for intake of well fluid, the shaft extending into the base member;

an inducer in the base member and mounted to the shaft for rotation therewith, the inducer having a helical flight to pump the well fluid into the centrifugal pump;

an injection port in the side wall of the base member;

an annular manifold mounted to and surrounding the side wall of the base member, the manifold having an annular chamber that communicates with the injection port; and an injection line running from surface level to the annular chamber for injecting diluent through the manifold and injection port into the base member, which mixes with the well fluid being pumped by the inducer into the centrifugal pump.

2. The pump assembly of claim 1, wherein the chamber has an open inner wall that extends circumferentially around the side wall of the base member.

3. The pump assembly of claim 1, wherein the manifold has an upper wall and the injection line is secured to an injection line port in the upper wall that communicates with the chamber.

4. The pump assembly of claim 1, further comprising a plurality of fasteners extending radially from the manifold into the side wall of the base member for securing the manifold to the base member.

5. The pump assembly of claim 1, further comprising a pair of annular seals located between the manifold and the side wall of the base member, one of the seals being above the injection port and one below the injection port, for sealing the chamber of the manifold to the side wall of the base member.

6. The pump assembly of claim 1, wherein the well fluid inlet is located in the side wall of the base member upstream of the manifold.

7. The pump assembly of claim 1, wherein the inducer has an upper end and a lower end, and wherein the injection port is enters the base member between the upper and lower ends of the inducer.

8. The pump assembly of claim 1, further comprising:

a guide vane mounted to the shaft for rotation therewith in the base member downstream of the inducer for imparting a swirling motion to the well fluid mixed with the diluent, causing liquid components within the well fluid to flow radially outward within the base member and gaseous components to flow toward a central area in the base member; and a discharge member located downstream of the guide vane, the discharge member having a central collection area for collecting and discharging the gaseous components into the well and an outer collection area for passing the liquid components into the centrifugal pump.

9. An electrical submersible well pump assembly comprising:

a centrifugal pump having a housing containing a plurality of impellers rotated by a shaft;

a tubular base member mounted to and extending downward from the housing, the base member having a side wall with a cylindrical upper portion and a conical lower portion, the shaft extending into the base member;

at least one well fluid inlet located in the conical lower portion for intake of well fluid into the base member;

an inducer in the base member and mounted to the shaft for rotation therewith, the inducer having a helical flight to pump the well fluid flowing into the intake into the centrifugal pump;

an injection port in the upper portion of the side wall of the base member adjacent the inducer;

an annular manifold mounted to and extending around the upper portion of the side wall of the base member, the manifold having an annular chamber that has an open inner side that communicates with the injection port; and an injection line running from surface level to the annular chamber for injecting diluent through the manifold and injection port into the base member where it mixes in the inducer with well fluid.

10. The pump assembly of claim 9, wherein the manifold has an upper wall and the injection line is secured to an injection line port in the upper wall that communicates with the chamber.

11. The pump assembly of claim 9, further comprising a plurality of fasteners extending radially from the manifold into the upper portion of the side wall of the base member for securing the manifold to the base member.

12. The pump assembly of claim 9, further comprising a pair of annular seals located between the manifold and the upper portion of the side wall of the base member, one of the seals being above the injection port and one below the injection port, for sealing the manifold to the upper portion of the side wall of the base member.

13. The pump assembly of claim 9, wherein the inducer has an upper end and a lower end, and wherein the injection port is located between the upper and lower ends.

14. The pump assembly of claim 9, further comprising:

a guide vane mounted to the shaft in the base member above the inducer for imparting a swirling motion to the well fluid mixed with the diluent, causing liquid components within the well fluid to flow radially outward within the base member and gaseous components to flow toward a central area in the base member; and a discharge member located above of the guide vane, the discharge member having a central collection area for collecting and discharging the gaseous components into the well and an outer collection area for passing the liquid components into the centrifugal pump.

15. A method of mixing diluent and well fluids in a down hole centrifugal pump having a base member with an intake for well fluid, comprising the steps of:

(a) mounting an inducer having a helical flight within the base member;

(b) providing an injection port through a side wall of the base member;

(c) mounting an annular manifold to the side wall of the base member, the manifold having an inner annular recess that extends around the side wall of the base member, defining a chamber that communicates with the injection port;

(d) deploying an injection line from the surface to the manifold;

(e) rotating the centrifugal pump and the helical flight of the inducer, causing the inducer to pump well fluid flowing from the intake into the centrifugal pump; and (f) delivering fluid down the injection line into the chamber of the manifold, which then flows through the injection port into the base member where it mixes with the well fluid being pumped by the inducer.

16. The method according to claim 15, wherein step (b) comprises mounting the injection port downstream of the intake.

17. The method according to claim 15, wherein step (b) comprises mounting the injection port above a lower end of the inducer.

18. The method according to claim 15, further comprising causing a swirling motion to the well fluid and the diluent at a point downstream of the inducer to separate liquid components in the well fluid from gaseous components, then discharging the gaseous components into the well before reaching the pump.

* * * * *